US005483911A

United States Patent [19]

Kubli

[11] Patent Number: 5,483,911

[45] Date of Patent: Jan. 16, 1996

[54] ELASTIC ANCHOR ROPE

[76] Inventor: Ronald N. Kubli, 135 Fern Valley Rd. #69, Medford, Oreg. 97501

[21] Appl. No.: 198,561

[22] Filed: Feb. 18, 1994

[51] Int. Cl.[6] ..... B63B 21/00

[52] U.S. Cl. ..... 114/230; 87/2; 114/294; 114/213

[58] Field of Search ..... 114/213, 215, 114/230, 294; 87/2, 6; 57/23; 267/69, 148

[56] References Cited

U.S. PATENT DOCUMENTS 2,452,228 10/1948 Dawes et al. ..... 87/2
2,561,487 7/1951 Bailhe ..... 114/230
4,258,608 3/1981 Brown ..... 114/215 X
4,513,063 4/1985 Hashi et al. ..... 87/2
5,083,522 1/1992 Ashrow ..... 114/215

*Primary Examiner*—Sherman Basinger
*Attorney, Agent, or Firm*—James D. Givnan, Jr.

[57] ABSTRACT

A hollow braid woven anchor rope having an elastic core, of tubular latex, occupies a major portion of rope length. Ends of the elastic core are secured to the rope proper by rings, one each, located on rope end segements. A snap assembly at one end of the rope facilitates attachment to an anchor. When not in use the elastic core collapses the rope to bunch the rope along the relaxed core. A method with a series of steps is disclosed for rope assembly by insertion of the core into the rope and securement of the core ends to end segments of the rope component.

5 Claims, 1 Drawing Sheet

ELASTIC ANCHOR ROPE

BACKGROUND OF THE INVENTION

The present invention pertains generally to ropes for the anchoring of various types of watercraft.

The running of small watercraft ashore or beaching incurs the risk of both damage to the hull and to the craft's propellor and associated lower drive of the propulsion unit. Further the action of waves on a beached craft over a short period of time, will result in damage to the surface of the craft's hull. Preferable to beaching of a watercraft is the anchoring of same close to shore but away from contact with any submerged obstacles. While anchoring off shore is preferable, it requires the availability of a second craft to carry the boat operator to shore.

SUMMARY OF THE PRESENT INVENTION

The present invention is embodied within an elastic anchor rope to permit retrieval of an empty boat away from a beach to an anchorage remote from beach and underwater obstacles.

The present rope assembly includes a braided rope of hollow or open center construction equipped at one of its ends with means for anchor attachment. An elastic core extends lengthwise of the rope for a major portion of rope length and is secured at its ends to the rope to compress or collapse the major portion of the rope along the elastic core to permit extension and contraction of the rope by a factor of three or thereabouts. In a typical use of the present elastic anchor rope a craft is anchored off shore with the craft being subsequently beached to disembark its passengers, whereafter the elastic rope will retrieve or retract the craft to its anchored location remote from the beach and from other obstacles that constitute a source of damage to the craft's hull. A tubular latex core provides extreme elasticity to accomplish the foregoing and to permit convenient later retrieval of the craft back to the beach by a bow line. Additionally, the present elastic anchor rope permits deep water anchoring with the craft being yieldably snubbed against wave action by an elastic anchor rope which permits yielding of the craft to wave and wind action to avoid undue stressing of the hull of the craft. The present invention additionally includes the method of construction of an elastic anchor rope.

Important objectives include the provision of an elastic anchor rope equipped for anchor attachment and with a major portion of the rope disposed about and collapsible on a tubular elastic core secured at its ends to opposite end segments of the rope; the provision of an elastic anchor rope which in its relaxed or contracted state is of greatly reduced length to provide an anchor rope easily stowed and yet one that permits offshore mooring of a boat without reliance on a second boat for disembarking of the boat operator; the provision of an elastic anchor rope that permits a boat to ride at anchor in a yieldable manner to avoid stressing of the boat hull by wave action; the provision of a method of forming an elastic anchor rope which permits rapid assembly of the rope and hence a low cost of manufacture.

DETAILED DESCRIPTION OF THE PREFERRED EMBODIMENTS

Figures 1, 2, 3, 4, 5, 6, 7:
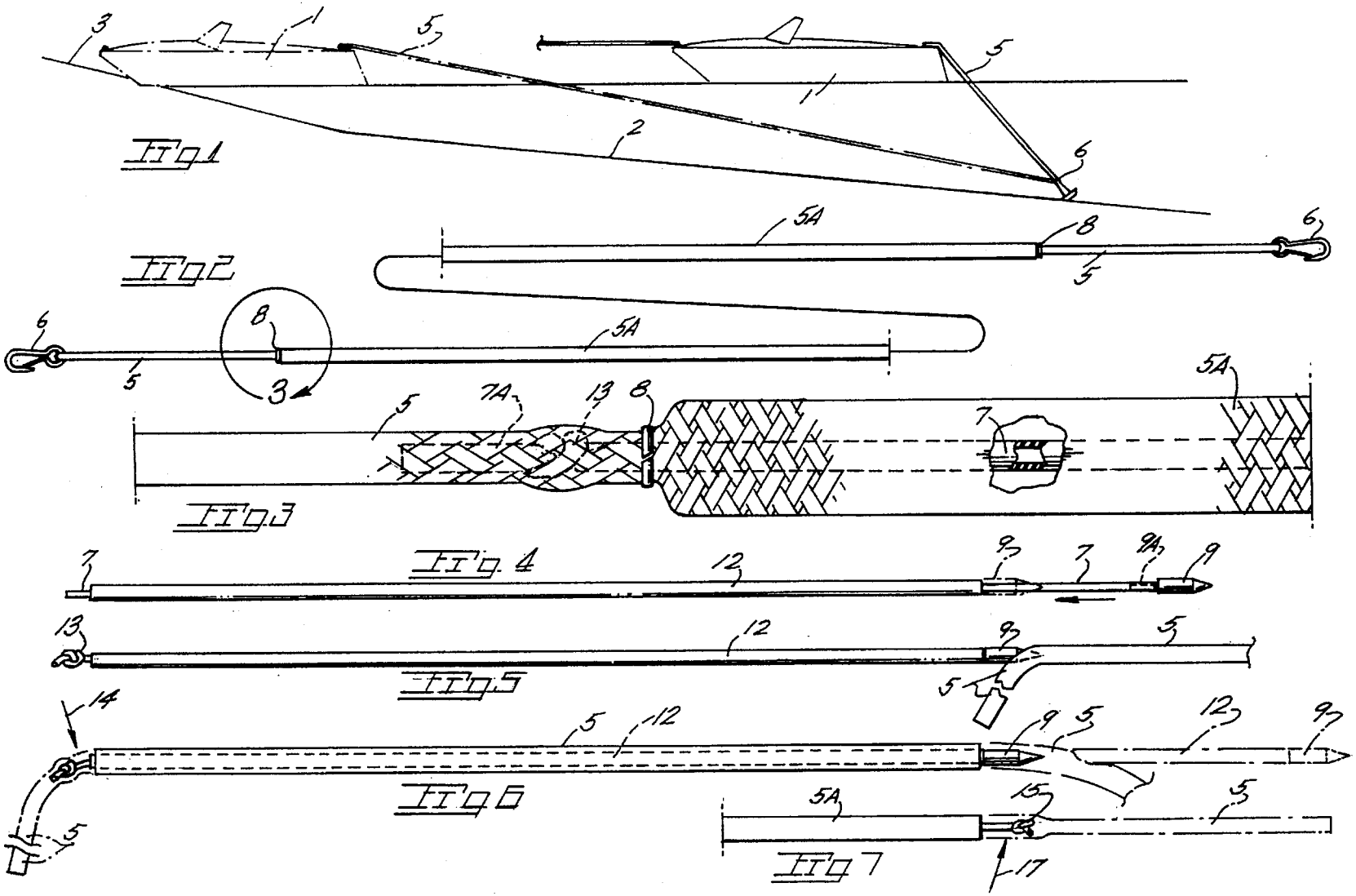
FIG. 1 is a schematic view of a boat anchored off shore after being momentarily beached to discharge passengers.
FIG. 2 is a side elevational view of the present elastic anchor rope sectioned for purposes of illustration.
FIG. 3 is an enlarged detail view of that portion of FIG. 2 encircled at 3.
FIGS. 4, 5, 6 and 7 disclose side elevational views of components of the present rope during rope assembly.

With continuing attention to the drawings wherein applied reference numerals indicate parts similarly hereinafter identified, the reference numeral 1 indicates a small watercraft such as a boat used for recreational purposes. A lake or river bed is at 2 while a beach is indicated at 3.

The present elastic anchor rope includes a rope indicated at 5 of woven construction termed hollow braid in the trade, with one such rope being of polypropylene filaments. A hook assembly at 6 is affixed to one or both ends of the rope such as by splicing of the rope ends.

An elastic core at 7 is housed internally of rope 5 with a suitable core being of pure latex and occupying a major portion of the length of rope 5 when core 7 is in a relaxed state as shown in FIG. 2 with a major segment 5A of rope 5 being collapsed along core 7. End segments of core 7 are indicated as at 7A and are attached to rope 5 by rings at 8 about the rope and core. Each end segment 7A of the elastic core 7 is knotted at 13 to ensure retention of the end segment when stretched against passage past rings 8.

In one suitable embodiment of the present rope, hollow braid rope 5 is approximately 50 feet in length prior to affixing the rope as above described to latex core 7 which, in the preferred embodiment, is approximately 10 feet in length. A major portion of the rope length is collapsed by relaxed latex core as shown in FIGS. 2 and 3. The preferred elastic member 7 is of tubular construction and ten feet or so in length.

With regard to the method of forming the present rope assembly the same comprises the steps of attaching an end of the elongate elastic core 7 to a fid 9 and thereafter inserting the core into a pipe 12 which is of approximately the same length as the relaxed tubing. The inserted free end of the core protrudes from the pipe and is subsequently tied into a knot 13. Fid 9, in place at the other end of pipe 12, is then inserted through the wall of hollow braid rope 5, adjacent one end of the rope, whereafter the remaining length of rope is drawn onto the length of pipe 12. Subsequently 18 inches or so of rope 5 is pulled off of pipe 12 and over knot 13 to locate knot 13 approximately 18 inches from the adjacent end of the rope. A wire ring 8 is then clamped about the rope and elastic tube therein at a point indicated by an arrow 14 to prevent slippage of the end of the elastic tube relative rope 5. Subsequently fid 9, adjacent the remaining end of the rope, i.e., approximately 18 inches from the rope end, is inserted through a wall of the hollow braid rope and pulled outwardly through the rope sidewall along with pipe 12. Upon detachment of the end of core 7 from a ribbed portion 9A of the fid, a knot 15 is tied in the core adjacent the core end, and thereafter inserted back into the rope through the opening formed during extraction of fid 9 and pipe 12. A second ring 8 is then clamped about rope and latex core 7 at a location indicated by arrow 17 to secure the remaining end of core 7 to rope 5.

In use, the rope 5 when extended to its full length will not exceed the stretch capability of core 7. In one embodiment of the present anchor rope 5 is of a fifty foot length with core 7 being ten feet in length and of pure latex with an outside diameter of three-eights inch and a stretch capability of approximately four to one.

While I have shown but one embodiment of the invention, it will be apparent to those skilled in the art that the invention may be embodied still otherwise without departing from the spirit and scope of the invention.

Having thus described the invention, what is claimed and desired to be secured by a Letters Patent is:

1. An elastic anchor rope for watercraft and comprising, a hollow braid rope of open center construction, attachment means on said rope offset from the rope ends with a major segment of the rope defined by said attachment means, a hook at one end of said rope for attachment to an anchor, an elongate elastic member lengthwise disposed in and attached to said rope and at all times whether relaxed or tensioned extending said major portion of the length of said rope and having end segments offset inwardly from the ends of said rope, said major portion of said rope collapsed by and along said elastic member when said elastic member is in a relaxed untensioned state, said attachment means attaching each of said end segments of the elastic member to the rope, and said elastic member serving to collapse said major portion of the rope extending intermediate said attachment means to permit anchoring of a watercraft in a yieldable manner to allow the discharge of boat occupants ashore with the anchor rope returning the boat to an offshore anchoring site.

2. The method of constructing an elastic rope assembly comprising the steps of, attaching one end of an elongate elastic member to a fid, inserting said elastic member into a pipe with said fid abutting an end of the pipe, inserting said pipe and the elastic member therein and said fid into a braided rope of open center construction of greater length than said elastic member, collapsing the rope onto said pipe, tying a first knot at the remaining end of said elastic member, extracting one end of said rope past said first knot, attaching a first ring about said rope and the elastic member therein inwardly offset from said knot, extracting said fid and said pipe and said one end of the elastic member from said rope, tying a second knot at said one end of the elastic member, re-inserting said one end of the elastic member into the rope, and attaching a second ring about the rope and the elastic member therein inwardly offset from said second knot.

3. The elastic anchor rope claimed in claim 1 wherein said elastic member is of tubular latex having an elastic capability of approximately four to one.

4. The elastic anchor rope claimed in claim 3 wherein said elastic member in its relaxed state serves to bunch a major portion of said rope to a collapsed state in place about the elastic member.

5. An elastic rope comprising, a braided rope of open center construction and having a major portion contracted in a linear manner, a hook at one end of said rope, an elongate elastic member of latex construction lengthwise disposed in said rope, said elastic member having said contracted major portion of said rope disposed thereon, attachment means spaced along said rope and defining said major portion and attaching the ends of said elongate elastic member to said rope, and said elongate elastic member and said major portion of said rope thereon having a stretch capability substantially four times the length of said elastic member when in a relaxed state.

* * * * *